US010113349B2

(12) United States Patent
Zimmer et al.

(10) Patent No.: US 10,113,349 B2
(45) Date of Patent: Oct. 30, 2018

(54) LOW-NOISE CARRIER ARRANGEMENT

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 15/072,007

(22) Filed: Mar. 16, 2016

(65) Prior Publication Data

US 2016/0340954 A1 Nov. 24, 2016

(30) Foreign Application Priority Data

Mar. 17, 2015 (DE) ..... 10 2015 003 424

(51) Int. Cl.

| | |
|---|---|
| ***E05F 3/02*** | (2006.01) |
| ***E05F 5/00*** | (2017.01) |
| ***E05F 1/16*** | (2006.01) |
| *E05D 15/06* | (2006.01) |

(52) U.S. Cl.

CPC ..... *E05F 3/02* (2013.01); *E05F 1/16* (2013.01); *E05F 5/003* (2013.01); *E05D 15/0669* (2013.01); *E05Y 2800/422* (2013.01); *E05Y 2800/45* (2013.01); *E05Y 2800/678* (2013.01); *E05Y 2800/68* (2013.01); *E05Y 2900/20* (2013.01)

(58) Field of Classification Search

CPC ..... E05F 3/02; E05F 1/16; E05F 5/003; E05F 15/0669

See application file for complete search history.

(56) References Cited

U.S. PATENT DOCUMENTS

| | | | | |
|---|---|---|---|---|
| 8,307,497 | B2 * | 11/2012 | Chang | E05F 5/003 16/49 |
| 8,745,821 | B2 * | 6/2014 | Chang | E05F 5/003 16/49 |
| 2011/0138579 | A1 * | 6/2011 | Sato | E05F 1/16 16/93 R |
| 2016/0076288 | A1 * | 3/2016 | Bantle | E05F 1/16 49/417 |
| 2016/0273253 | A1 * | 9/2016 | Zimmer | E05D 15/0669 |
| 2016/0273254 | A1 * | 9/2016 | Zimmer | E06B 3/4636 |
| 2016/0273256 | A1 * | 9/2016 | Zimmer | E05F 5/027 |
| 2016/0333622 | A1 * | 11/2016 | Glogowski | E05F 5/003 |
| 2016/0340955 | A1 * | 11/2016 | Zimmer | E05F 5/003 |

FOREIGN PATENT DOCUMENTS

| | | | |
|---|---|---|---|
| CN | 000202509933 | U | 4/2012 |
| DE | 10 2006 007 897 | A1 | 10/2006 |
| DE | 102010036468 | A1 | 1/2012 |
| EP | 2 317 056 | | 12/2009 |
| JP | 2008-223456 | A | 9/2008 |

* cited by examiner

*Primary Examiner* — Jeffrey O'Brien
(74) *Attorney, Agent, or Firm* — Klaus J. Bach

(57) ABSTRACT

In a draw-in arrangement with a carrier element, which is movable back and forth from a force- and/or form-locking fixed park position to an end position and a carrier which can be coupled to the carrier element, the carrier is provided with a stop projection having a stop surface area and the carrier element has an engagement projection with a push surface area for contact with the stop projection. The stop projection is provided with a carrier-side surface layer. At least one of the surface areas is provided with an elastic surface layer to prevent contact noises. The invention also resides in a sliding door arrangement with such a draw-in arrangement to prevent contact noises.

5 Claims, 6 Drawing Sheets

LOW-NOISE CARRIER ARRANGEMENT

BACKGROUND OF THE INVENTION

The invention concerns a draw-in arrangement with a carrier element which is movable back and forth from a park position, in which it can be held in a force or form-locking manner, to an end position and a carrier which can be coupled to the carrier element, wherein the coupled carrier has an engagement pin with a contact surface facing the end position and the carrier element has a push pin with a push surface which faces away from the park position for contacting the push pin, and a sliding door arrangement with such a draw-in arrangement.

CN 202 509 933 U discloses such a draw-in arrangement. However, during closing of the door, audible noises may be generated when the carrier element comes into contact with the carrier.

It is the object of the present invention to provide a low-noise draw-in arrangement.

SUMMARY OF THE INVENTION

In the draw-in arrangement according to the invention, the carrier is provided at least on its contact surface with a surface layer. The push surface of the push pin also is provided with a surface layer. Both surface layers have at least a thickness of 1.5 millimeter and the elasticity module of these surface layers has a mean value at room temperature of between 700 N/mm$^2$ and 1600 N/mm$^2$.

The invention will become more readily apparent from the following description thereof with reference to the accompanying drawings.

BRIEF DESCRIPTION OF THE DRAWINGS

It is shown in.

DESCRIPTION OF EXEMPLARY EMBODIMENTS

Figure 1:
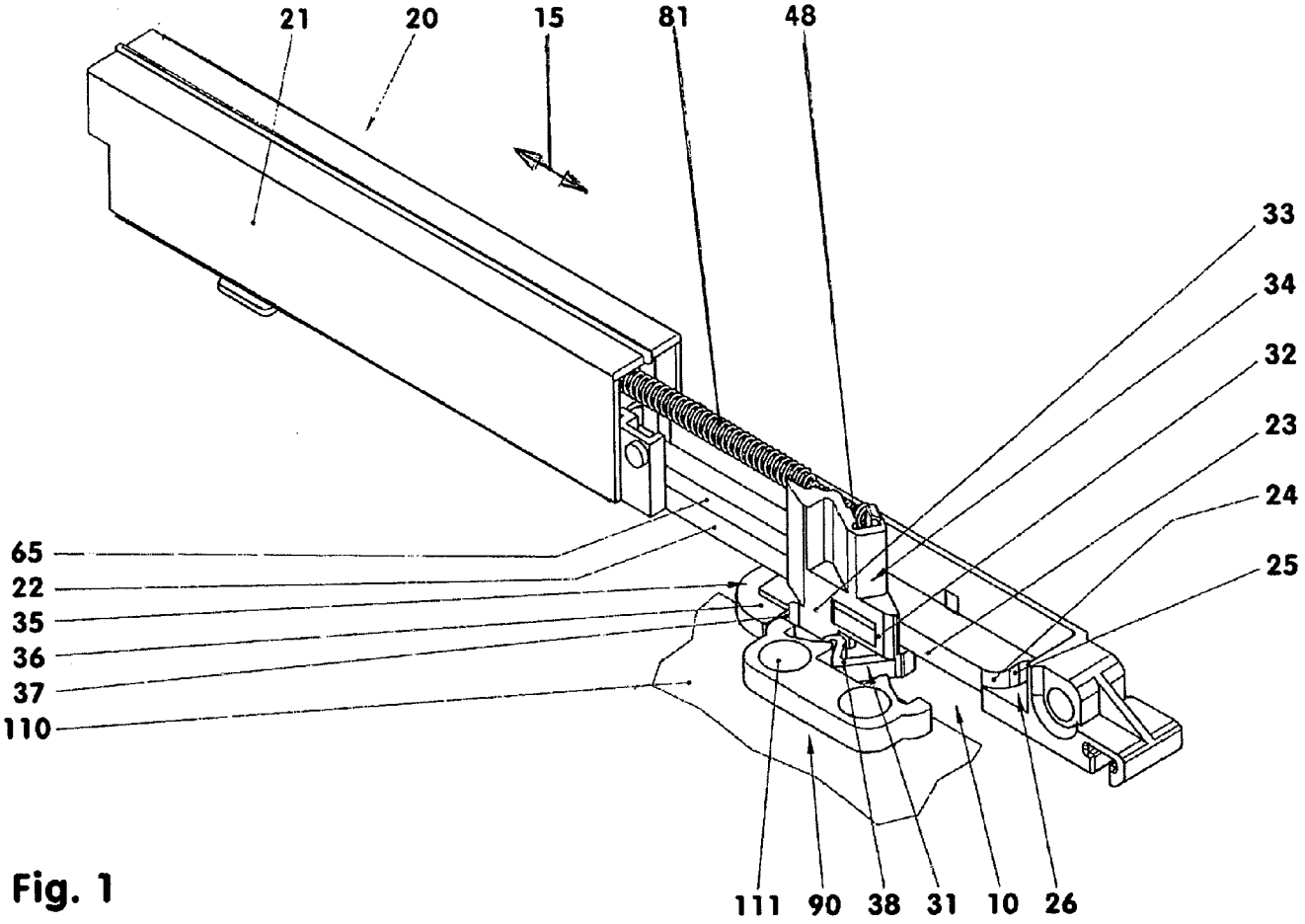
FIG. 1: a draw-in arrangement.

FIG. 1 shows a draw-in arrangement 10. Such draw-in arrangements 10 are used to move furniture parts such as sliding doors, drawers etc., which are movable relative to a stationary furniture body, in a controlled manner back into their end position. In this process, before reaching for example the closed end position, the resultant force of a combined acceleration and deceleration device 20 is applied to movable furniture parts so that they reach their end position at slow speed and without a shock.

The draw-in arrangement 10 comprises the combined acceleration and deceleration device 20 and a carrier 90. In such an arrangement, the combined acceleration and deceleration device 20 is for example arranged on the movable furniture part and the carrier 90 is arranged on the stationary furniture body. But it is also conceivable to arrange the carrier 90 on the movable furniture part and the acceleration and deceleration device 20 on the stationary furniture body.

The acceleration and deceleration device 20 comprises a support part 21 and a carrier element 31 which is guided along the support part 21. The support part 21 has a continuous guide surface 22 along which the carrier element 31 is movable back and forth from a force- and/or form-locking park position to an end position. The carrier element 31 is connected to a piston rod 65 of a cylinder-piston unit 61 which is arranged in the support part 21 and an energy store 81 which is attached to the support part 21 so that the energy store 81 biases the carrier element 31 toward the park position against the effect of the cylinder-piston unit 61.

The guide surface 22 of the support part 21 comprises a guide section 23 and a holding section 25. The two sections 23, 25 may extend for example normal relative to each other and are joined by a curved section 24. The holding section 25 and the curved section 24 are part of a guide groove 26, which is provided at its end, with an expanded area 27, see FIG. 4.

Figure 2:
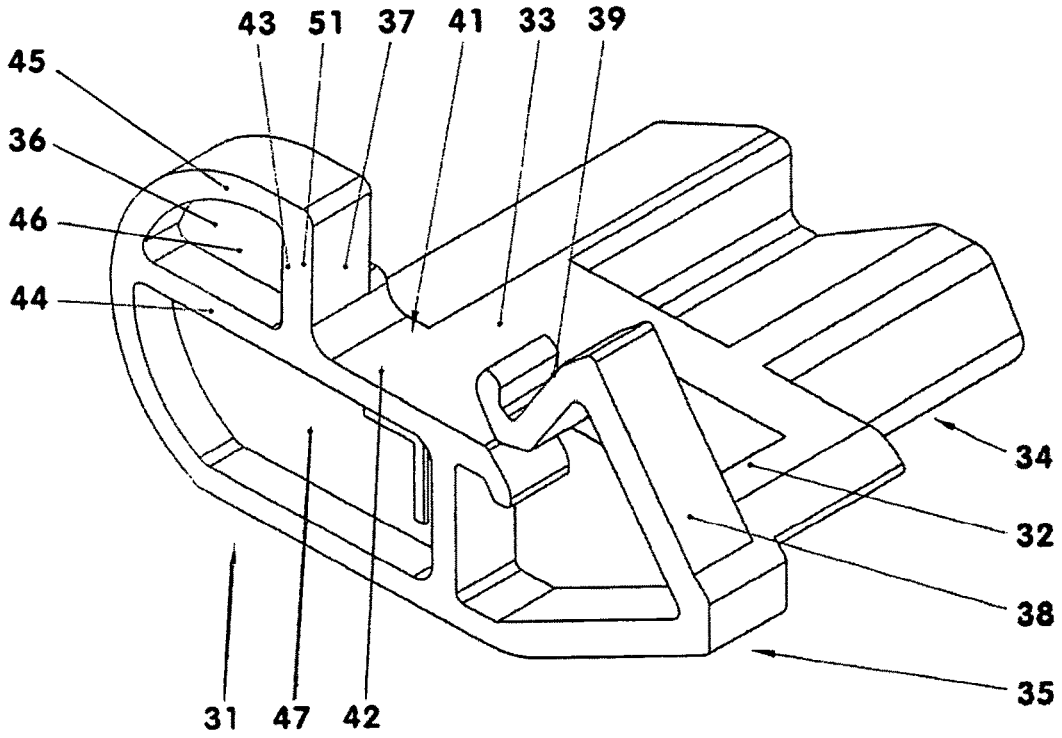
FIG. 2: a carrier element.

FIG. 2 shows the carrier element 31. The carrier element 31 has two slide elements 32, 33, which extend over the support part 21. These slide elements 32, 33 are provided between a guide and accommodation area 34 and an engagement area 35. They are spaced from each other and abut the guide surface 22.

The engagement area 35 comprises an engagement projection 36 and a pull member 38. For engagement, the engagement projection 36 extends around the end of the carrier element 31 which faces toward the end position. The engagement projection 36 delimits with a push surface area 37 and the pull member 38 delimits with a pull surface area 39 a carrier element recess 41. The push surface area 37 and the pull surface area 39 face each other for example. In the exemplary embodiment, the planar areas of the push surface area 37 and the pull surface area 39 extend at an angle of 35°. The carrier element recess 41 is further delimited by a bottom surface area 42 which extends for example parallel to a tangential plane of the slide elements 32, 33. The pull member 38 which, for example in a bottom view of the acceleration and deceleration device 61, has a triangular shape is elastic for example by being provided with a film joint.

Figure 7:
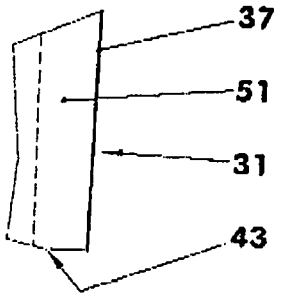
FIG. 7: an enlarged cross-sectional view of a section of a push web.

The engagement projection 36 includes a push web 43 which extends around the push surface area 37 and which is supported by a bottom web 44 and a curved head web 45. The head web 45 and the bottom web 44 are joined at the end facing away from the push web 43. All three webs 43-45 have the same thickness as shown in the exemplary embodiment. In the space formed by the three webs 43-45, a longitudinal web 46 is arranged. The thickness of the longitudinal web 46 is for example 80% of the thickness of the other webs 43-45. In the exemplary embodiment, the longitudinal web 46 is disposed flush with one side of the other webs 43-45. But the longitudinal web 41 may also be thinner and/or it may also be arranged in the center of the other webs 43-45. Also, an engagement projection 36 without a longitudinal web 46 without a head web 45 or without a bottom web 44 is conceivable. The push surface area 37 of the push web 43 is part of a delimiting wall 51. The thickness of this delimiting wall 51 in which the material is homogeneous is at least 1.5 mm (see FIG. 7). In the exemplary embodiment, the whole carrier element 31 consists of a thermoplastic material such as polyoxymethylene (POM). This material has for example a hardness of between 65 Shore D and 85 Shore D. Its elasticity modulus at room temperature is between 1500 Newton/mm$^2$ and 3000 Newton/mm$^2$. As elasticity modulus here, the so-called short-term elasticity modulus is used which is determined by a loading in a time interval of less than 10 minutes. The mentioned elasticity modulus is the pressure-elasticity modulus with a compression of between 0.5% and 1%, which, for the material mentioned, is for example lower, by 15%, than the stress elasticity modulus with an extension of between 0.5% and 1%.

The interface layer 51 may also consist of a material with an elasticity modulus which is lower than that of the rest of the carrier element 31. The delimiting wall 5 may also include for example an elastomer material which is vulcanized onto the support body 47 of the carrier element 31. Such a material may be for example nitrile butadiene coautchouck (NBR), whose elasticity modulus under the above-mentioned conditions is between 4 Newton/mm$^2$ and 20 Newton/mm$^2$.

The push web 43 may have an essentially rectangular cross-section. It can be in the form of a solid or a hollow structure. It may also have a cross-section in the shape of a U or a T or a double T, wherein a leg of the U or a strap of the T extends around the engagement projection 37. The thickness of the push web 43 may be greater than the dimension given above. It is also possible that the whole carrier element 31 consists of a material, whose elasticity modulus is lower than 700 Newton/mm$^2$.

The guide and accommodation area 34 comprises a spring holder 48 and a piston rod holder 49. Both holders 48, 49 face in the exemplary embodiment toward the end position. In the spring holder 48, one end of the energy store 81 of the acceleration and deceleration device 20 is engaged. In the exemplary embodiment, the energy store 81 is in the form of a tension spring 81. The other end of the tension spring 81 is engaged in the support part 21.

Figure 4:
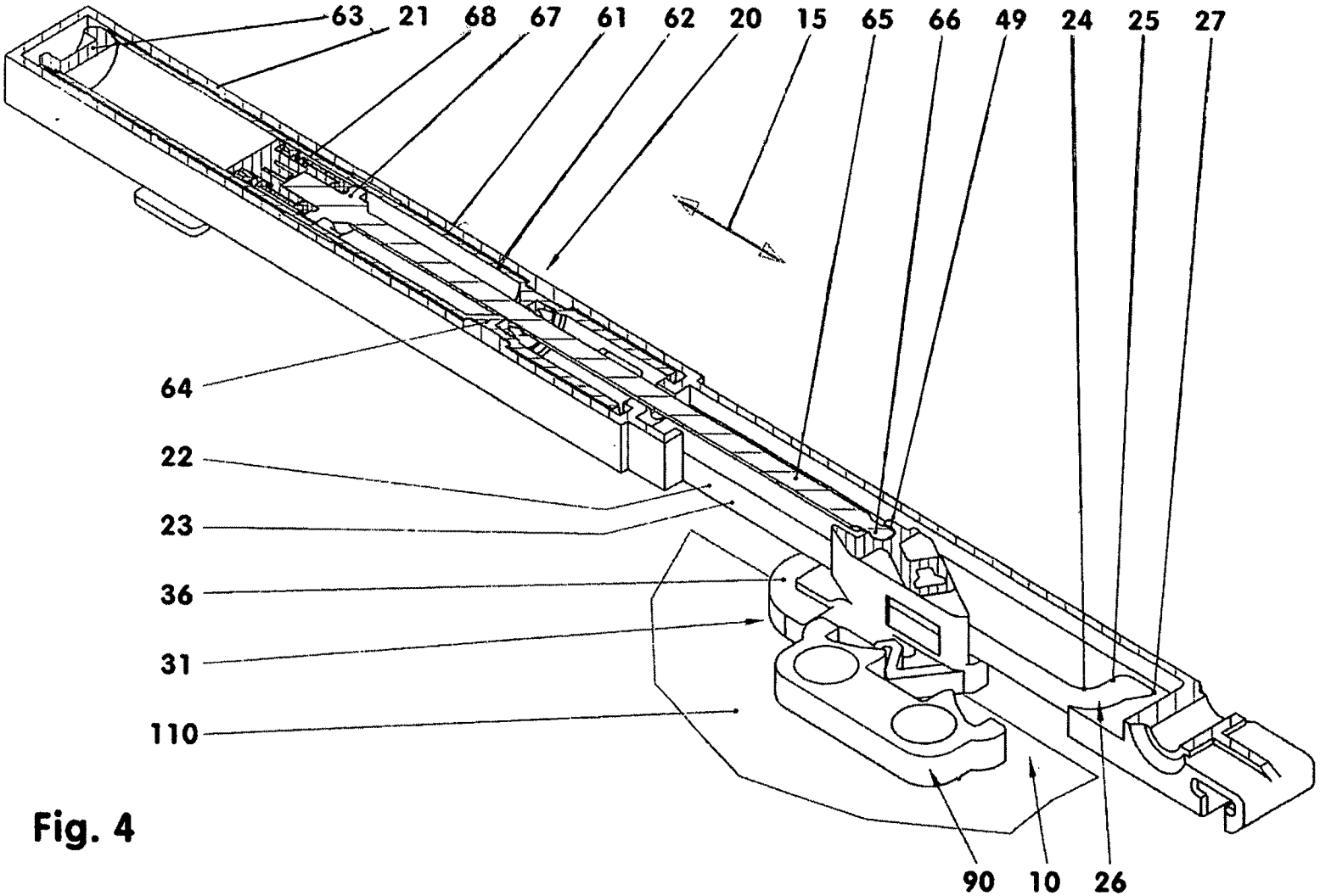
FIG. 4: a longitudinal cross-section of the draw-in arrangement.

In FIG. 4, the acceleration and deceleration 20 is shown in a longitudinal cross-sectional view. In the piston rod holder 49 of the carrier element 31 a piston rod heads 66 of the cylinder piston unit 61 is pivotally supports. The cylinder piston-unit 61 comprises a cylinder 62 and a piston 67, which is guided in the cylinder 62 by a piston rod 65. The cylinder 62 is closed by a bottom plug 63. The inner wall of the cylinder 62 may be cylindrical or conical. The inner cylinder wall has for example two longitudinally oriented grooves of different length which both extend from the cylinder bottom plug 63. The length of the shorter groove is for example one fourth of the length of the cylinder. The length of the longer groove is for example three-fourths of the length of the cylinder 62. At the piston rod-side end, the cylinder 62 is closed by a cylinder head 62 with piston rod seal.

In the exemplary embodiment, the piston 67 has a piston seal 68 with seal lips which are oriented toward the cylinder bottom plug 63. The piston 67 may be formed integrally with the piston rod 65 and/or with the piston seal 68.

The carrier 90 is shown in FIG. 1 arranged on a door track 110 of the furniture body. It is mounted there for example by two screws 111. The distance of the carrier 90 from the vertical door frame, on which the sliding door abuts when it is closed, is smaller than the distance in the longitudinal direction 15 between the park position and the end position. The longitudinal direction 15 herein is the direction in which the acceleration and deceleration device 20 extends and in which for example also the sliding door is oriented.

Figure 3:
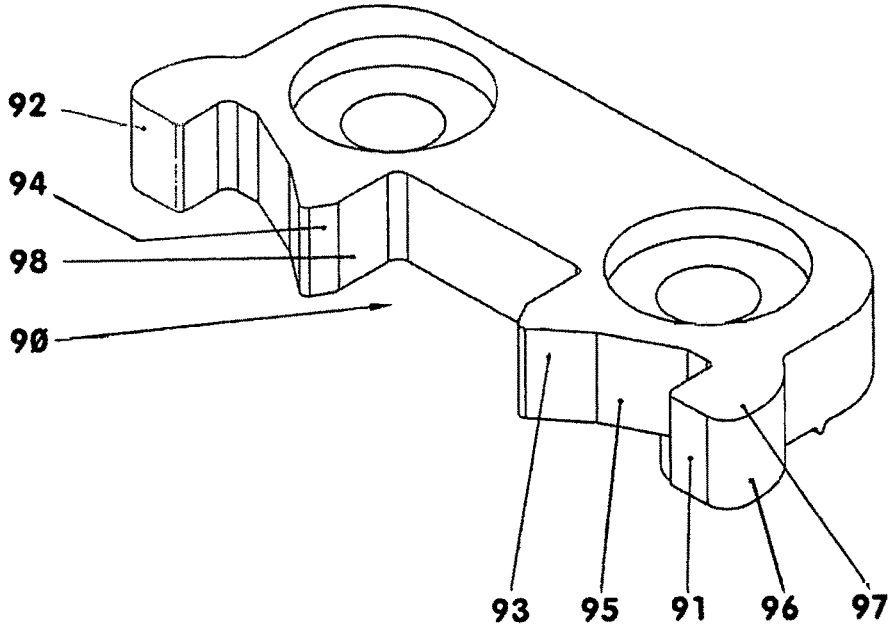
FIG. 3: a carrier.

FIG. 3 shows the carrier 90. This is a component which is oriented in the longitudinal direction 15 of the acceleration and deceleration device 20 and which is shown in the exemplary embodiment to be symmetrical with respect to its transverse center plane. The carrier 90 has at its longitudinal side facing the acceleration and deceleration device 20 two outwardly projecting stops 91, 92 and two guide lugs 93, 94. Between the stops 91, 92 and the guide lugs 93, 94 a holding recess 95 is provided.

In FIG. 1, the carrier 90 is shown in engagement with a left-sided acceleration and deceleration device 20. Left-sided in this case means that, when viewing the acceleration and deceleration device 20 from the park position in the direction toward the end position, the bottom carrier element 31 projects from the acceleration and deceleration device 20 toward the left. In this view, for example, the interior of the closet is arranged to the left of the acceleration and deceleration device 20. With the use of a left-sided acceleration and deceleration device 20, the stop 91 and the left guide lug 93 as shown in FIG. 1 are effective. With the use of a right-sided acceleration and deceleration device, the right stop 92 and the right guide lug 94 are effective.

Figure 8:
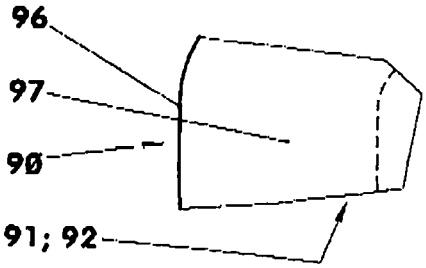
FIG. 8: an enlarged cross-sectional view of an individual stop.

The individual stop 91, 92 comprises an outer carrier surface area 96. This carrier surface area 96 is part of a contact layer 97 whose thickness is at least 1.5 mm. The carrier surface area 96 has for example a central planar section followed by convexly curved transition sections (see FIG. 3 and FIG. 8). The contact layer 97 may also extend over the whole stop 91, 92 or over the whole carrier 90. If the contact layer extends over the whole stop 91, 92, the contact layer 97 has for example a thickness of less than 10 mm.

The individual guide lug 93, 94 has a contact surface 98 which faces the second guide lug 94, 93. The contact surface 98 has a planar area from which convexly curved surface areas extend. The contact surface 98 may be part of an interface layer.

In the exemplary embodiment, the whole carrier 90 is manufactured from a thermoplastic elastomer such as polypropylene, polyethylene, etc. These materials have an elasticity modulus of between 1000 Newton/mm$^2$ and 1500 Newton/mm$^2$. The definition of the elasticity modulus corresponds to the definition given above. The hardness of this material is for example between 60 Shore A and 85 Shore A. However, the carrier may also be manufactured from a thermoplastic urethane such as polyurethane or from an elastomer material, for example, nitrile-butadiene caoutchouc (NBR).

The carrier 90 may also be constructed in such a way that only the contact layer 97 consists of the thermoplastic elastomer, the thermoplastic urethane or the elastomer material. The material of the carrier provided with the contact layer 97 may then for example be steel a duroplastic material or a thermoplastic material. The contact layer 97 may then for example be vulcanized onto the carrier.

The distance of the contact surface 98 from the carrier surface area 96 may be smaller than the distance of the pull surface area 31 from the push surface area 37. But it is also possible that the distances are the same or that, for forming a press fit, the distance of the contact surface 98 from the carrier surface area 96 is slightly larger than the distance of the pull surface area 39 from the push surface area 37.

During installation the deceleration and acceleration device 20 is attached for example to the sliding door and the carrier 90 is attached to the door track 110. The sliding door is then movable in the longitudinal direction 15 relative to the carrier 90 between an open and a closed position.

When the sliding door is opened, the carrier element 31 is in the park position. Herein, the slide 32 facing away from the cylinder-piston unit 20 is disposed in the holding section 25 of the guide surface 22. It is secured in this position by the tensioned tension spring 81. The other slide element 33 is disposed in the guide section 23. The piston rod 65 of the cylinder-piston unit 61 is extended.

For example upon closing the sliding door, the carrier element 31 contacts with the push surface area 37 the carrier surface area 96 of the carrier 90. The mean value of the elasticity modulus of the two contact surface layer areas 51, 97 disposed on the respective push and carrier surface 37, 96 is in the area of between 700 Newton/mm$^2$ and 1600 Newton/mm$^2$. When the two surface layer areas 51, 97 come into contact, at least the surface layer 51, 97 with the lower elasticity modulus is elastically deformed. Upon contacting therefore, no noise is generated.

With the continued closing movement, the carrier element 31 is pivoted out of the park position into the straight guide section 23. Hereby, the pull member 38 can contact the carrier 90 at the contact surface 98. The carrier 90 can be tightly engaged in the carrier element recess 41. With the establishment of the contact surface 98 and/or the pull surface area 39 as part of a contact layer with an elasticity modulus of less than 1500 Newton/mm$^2$, no noise is generated also in this case when contact is made.

It is also possible that, upon contacting a pull member 38 with a film joint, the pull member 38 is deformed when being contacted by the carrier 90. Also, with such an embodiment the carrier 90 can be tightly engaged in the carrier element recess 41 of the carrier element 31 upon pivoting of the carrier element 31 in the straight guide section 23.

After the carrier element 31 has been pivoted out of the park position, the energy store 81 is discharged and the carrier element 31 is pulled toward the end position. The sliding door is pulled herewith for example to its closed position. At the same time, the carrier element 31 which moves relative to the cylinder 62 pushes the piston 67 into the cylinder 62. The sealing lip of the piston seal 68 then abuts the inner cylinder wall and hermetically seals, in the cylinder interior, a displacement chamber against a compensation chamber. The sliding door is braked down thereby. As soon as, with further closing of the sliding door, the piston 67 reaches the first longitudinal groove in the cylinder wall, pressurized gas escapes along this throttling groove from the displacement chamber into the compensation chamber. The movement of the sliding door is determined by the acceleration force provided by the energy store 81 and the deceleration force generated by the cylinder piston unit 61. As soon as the piston 67 reaches the shorter longitudinal groove the deceleration force is further reduced. The sliding door now moves slowly to its closed end position. There it comes to a standstill without a shock.

With a manual or motor-operated opening of the sliding door out of its closed position, the carrier 90 pulls the carrier element 31 out of the end position along the guide surface 22 toward the park position. The energy store 81 is charged in the process. As soon as the—in opening direction—front slide element 32 reaches the guide groove 26, the carrier element 31 is pivoted under the force effect of the spring 81. It is now in a force-locking and/or form-locking park position. With further opening of the sliding door, the carrier element 31 is released from the carrier 90. The carrier element 31 now remains in the park position while the sliding door can be further opened.

The sliding door may be provided with an additional draw-in arrangement 10 which is arranged at the end of the door facing in the opening direction of the sliding door. With such an arrangement, the acceleration and deceleration device 20 can be used for a controlled approach of the sliding door to the open end position.

Figure 5:
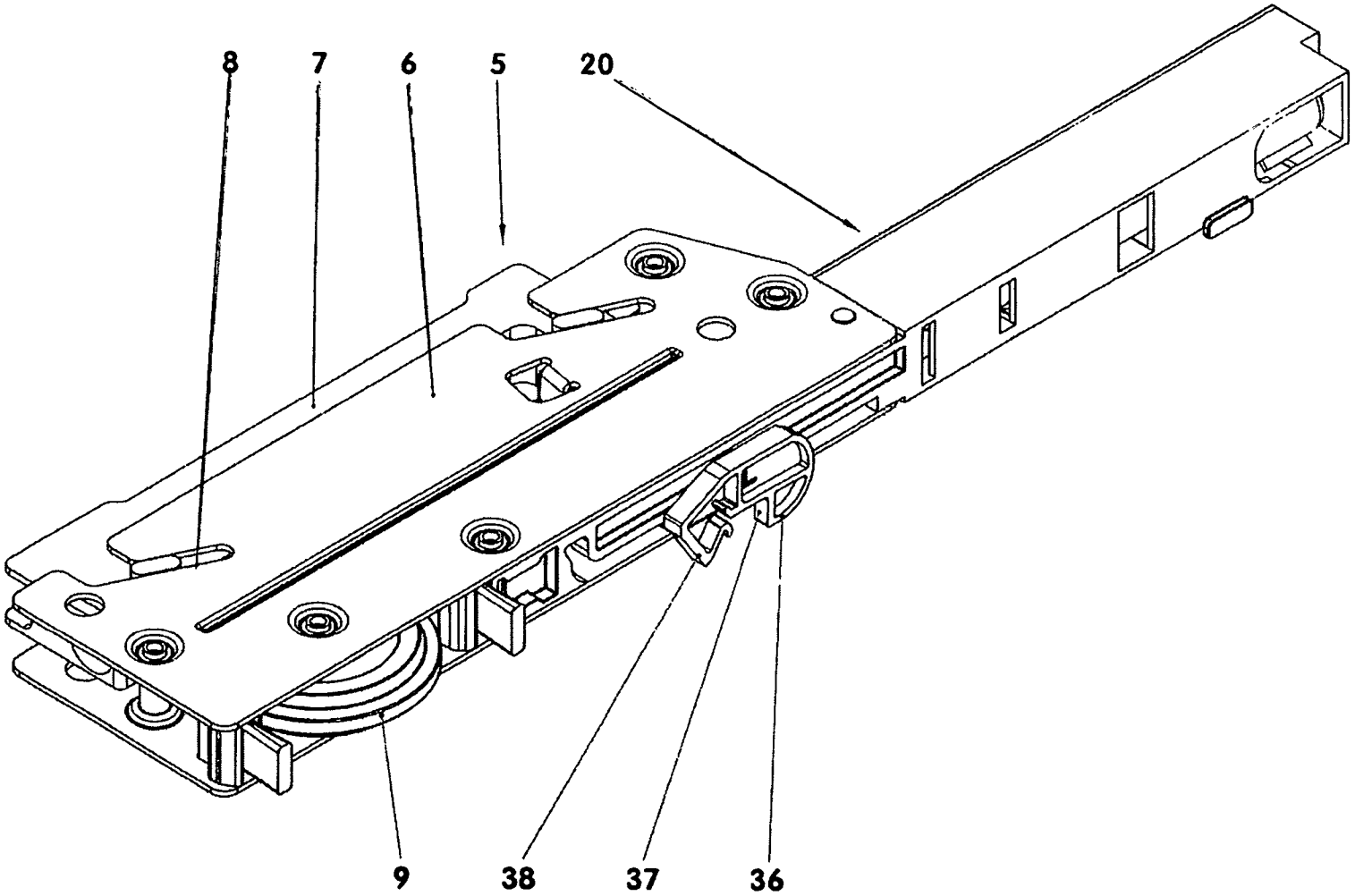
FIG. 5: a height adjustable door fitting.

FIG. 5 shows a height-adjustable door fitting 5 with an acceleration and deceleration device 20. The acceleration and deceleration device 20 is also in this exemplary embodiment part of the draw-in arrangement 10 which comprises a door track-side carrier 90.

As shown, the door fitting 5 comprises a housing 6 and a lifting member 7 which is adjustable relative to the housing 6. The acceleration and deceleration device 20 is fixed in the housing 6. For height adjustment of the door fitting 5, the lifting member 7 can be moved along several guide ramps 8 from a rest position to a raised operating position. The door fitting 5 includes a support roller 9 disposed in the housing 6.

Figure 6:
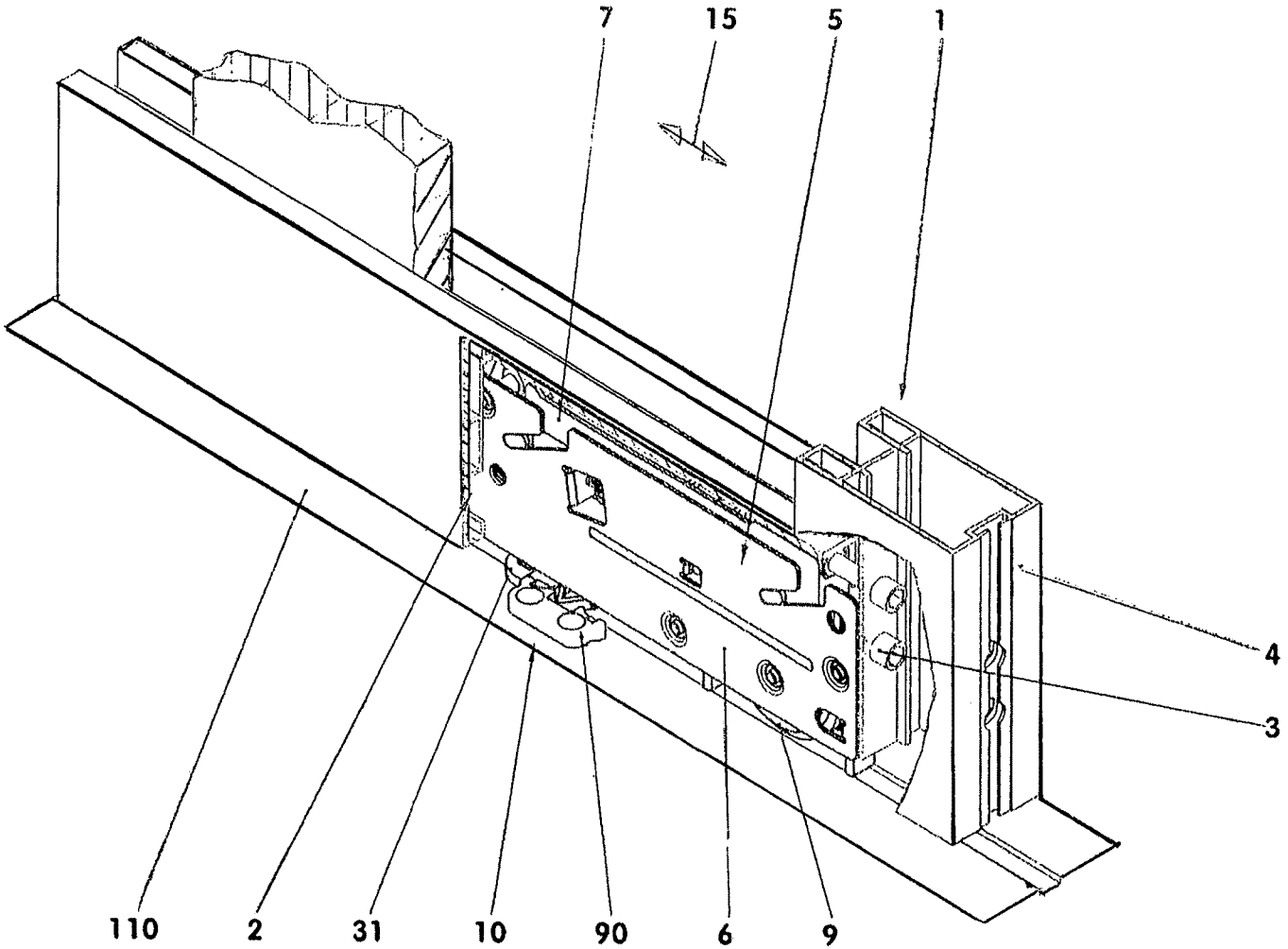
FIG. 6: a sliding door arrangement

As shown in FIG. 6, the door fitting 5 is installed in the sliding door 1. It is arranged for example in a recess 2 of the sliding door 1. The lifting member 7 supports the sliding door 1. In this embodiment, the adjustment arrangement comprises an adjustment screw 3, by which the lifting member 7 is adjustable relative to the door frame 4.

Also combination of the various exemplary embodiments are possible.

| Reference Number Listing | |
|---|---|
| 1 | Sliding door |
| 2 | Recess |
| 3 | Adjustment screw |
| 4 | Door frame |
| 5 | Door fitting, height adjustable |
| 6 | Housing |
| 7 | Lifting member |
| 8 | Guide ramp |
| 9 | Support roller |
| 10 | Draw-in arrangement |
| 15 | Longitudinal direction |
| 20 | Acceleration and deceleration device |
| 21 | Support part |
| 22 | Guide surface |
| 23 | Guide section |
| 24 | Curved section |
| 25 | Holding section |
| 26 | Guide groove |
| 27 | Expanded area |
| 31 | Carrier element |
| 32 | Slide element |
| 33 | Slide element |
| 34 | Guide and accommodation area |
| 35 | Engagement area |
| 36 | Engagement projection |
| 37 | Push surface area |
| 38 | Pull member |
| 39 | Pull surface area |
| 41 | Carrier element recess |
| 42 | Bottom surface area |
| 43 | Push web |
| 44 | Bottom web |
| 45 | Head web |
| 46 | Longitudinal web |
| 47 | Support body |
| 48 | Spring holder |
| 49 | Piston rod holder |
| 51 | Delimiting wall contact layer |
| 61 | Cylinder piston unit |
| 62 | Cylinder |
| 63 | Cylinder bottom plug |
| 64 | Cylinder head |
| 65 | Piston rod |
| 66 | Piston rod head |
| 67 | Piston |
| 68 | Piston seal |
| 81 | Energy store, tension spring |
| 90 | Carrier |
| 91 | Stop |

-continued

| Reference Number Listing | |
|---|---|
| 92 | Stop |
| 93 | Guide lug |
| 94 | Guide lug |
| 95 | Holding recess |
| 96 | Carrier surface area |
| 97 | Contact layer |
| 98 | Contact surface |
| 110 | Door track |
| 111 | Screws |

What is claimed is:

1. A draw-in arrangement (10) comprising a carrier element (31) which is movable back and forth between a fixed park position and an end position, an acceleration and deceleration device (20) with an energy store (81) for drawing the carrier element (31) toward the park position and a pneumatic cylinder-piston unit (61) for decelerating the movement of the carrier element (31) and a carrier (90) which includes a holding recess (95) for accommodating the carrier element (31) and is provided with a stop (91, 92) facing toward the end position and with a carrier surface area (96), and the carrier element (31) has an engagement projection (36) which includes a push surface area (37) which faces away from the park position and which is contactable with the stop (91, 92), wherein the carrier (90) is provided with a contact layer (97) surrounding at least the carrier surface area (96), the engagement projection (36) is provided with a carrier element-side delimiting wall layer (51) surrounding the push surface area (37), both, the wall layer (51) and the contact layer (97), have at least a thickness of 1.5 millimeters, and both, the wall layer (51) and the contact layer (97), have a mean elasticity modulus at room temperature of between 700 Newton/$mm^2$ and 1600 Newton/$mm^2$.

2. The draw-in arrangement (10) according to claim 1 wherein, the elasticity modulus of the carrier element-side delimiting wall interface layer (51) is greater than the elasticity modulus of the carrier-side interface layer (97).

3. The draw-in arrangement (10) according to claim 1, wherein the carrier element (31) is provided with a pull member (38) which is contactable with a guide lug (93, 94) of the carrier (90).

4. The draw-in arrangement (10) according to claim 3, wherein the carrier element (31) and the carrier (90) are engaged, when coupled, by a press fit.

5. A sliding door arrangement (10) including a draw-in arrangement according to claim 1, wherein the acceleration and deceleration device (20) is arranged within a height-adjustable door fitting (5).

* * * * *